US008344959B2

(12) United States Patent
Autti et al.

(10) Patent No.: US 8,344,959 B2
(45) Date of Patent: Jan. 1, 2013

(54) MULTIPROTOCOL ANTENNA FOR WIRELESS SYSTEMS

(75) Inventors: Marko Tapio Autti, Oulu (FI); Jouni Vesa Karkinen, Oulu (FI)

(73) Assignee: Nokia Corporation, Espoo (FI)

( * ) Notice: Subject to any disclaimer, the term of this patent is extended or adjusted under 35 U.S.C. 154(b) by 704 days.

(21) Appl. No.: 12/387,355

(22) Filed: Apr. 30, 2009

(65) Prior Publication Data

US 2010/0277383 A1 Nov. 4, 2010

(51) Int. Cl.
*H01Q 11/12* (2006.01)

(52) U.S. Cl. ..... 343/744; 343/743

(58) Field of Classification Search ..... 343/749, 343/722, 725, 739–740, 751–752, 852, 859, 343/865, 743, 744
See application file for complete search history.

(56) References Cited

U.S. PATENT DOCUMENTS

| | | | | |
|---|---|---|---|---|
| 5,767,812 | A * | 6/1998 | Basciano et al. | 343/722 |
| 6,950,410 | B1 | 9/2005 | Brandt | 370/276 |
| 7,248,165 | B2 * | 7/2007 | Collins et al. | 340/572.1 |
| 7,376,440 | B2 | 5/2008 | Forrester et al. | 455/553.1 |
| 7,650,114 | B2 * | 1/2010 | Tsirline et al. | 455/41.2 |
| 7,701,401 | B2 * | 4/2010 | Suzuki et al. | 343/702 |
| 7,760,093 | B2 * | 7/2010 | Rofougaran | 340/572.1 |
| 7,843,347 | B2 * | 11/2010 | Nikitin et al. | 340/572.7 |
| 8,063,769 | B2 * | 11/2011 | Rofougaran | 340/539.1 |
| 2007/0190939 | A1 * | 8/2007 | Abel | 455/41.2 |
| 2008/0081631 | A1 | 4/2008 | Rofougaran | 455/452.1 |
| 2008/0233868 | A1 | 9/2008 | Rofougaran et al. | 455/41.1 |
| 2008/0233880 | A1 * | 9/2008 | Rofougaran et al. | 455/42 |
| 2008/0252534 | A1 | 10/2008 | Okayama et al. | 343/702 |
| 2008/0287071 | A1 | 11/2008 | Gau et al. | 455/73 |
| 2009/0322634 | A1 * | 12/2009 | Yun et al. | 343/741 |

FOREIGN PATENT DOCUMENTS

| | | | |
|---|---|---|---|
| EP | 2 065 969 | A1 | 6/2009 |
| EP | 2 219 265 | A1 | 8/2010 |
| EP | 2 221 914 | A1 | 8/2010 |
| EP | 1 968 852 | B1 | 9/2010 |
| JP | 56160148 | A | 12/1981 |
| JP | 2003133991 | A | 5/2003 |
| WO | WO 2005/104389 | A1 | 11/2005 |
| WO | WO 2006/082328 | A2 | 8/2006 |
| WO | WO-2006/088422 | A1 | 8/2006 |

OTHER PUBLICATIONS

"Built-In Handset Antennas Enable FM Transceivers in Mobile Phones", Peter Lindberg and Andrei Kaikkonen, Jul. 2007, pp. 18-24.

* cited by examiner

*Primary Examiner* — Jacob Y Choi
*Assistant Examiner* — Kyana R McCain
(74) *Attorney, Agent, or Firm* — Harrington & Smith

(57) ABSTRACT

First, second and third feed ports interface to an antenna that has an impedance disposed between its ends which are defined by the first and second feed ports. The third feed port interfaces to the antenna at an intermediate point between the ends. In a first mode (balanced mode) the impedance enables signals to/from the first and second feed ports to resonate along the whole of the antenna, and in a second mode the impedance enables signals to/from the third feed port to resonate along a portion of the antenna, the portion terminating at the impedance. In embodiments, the first mode is for RFID signals and the second mode is for any one or more of Bluetooth/WLAN/GPS/FM signals. The first and second mode may operate simultaneously. Also detailed is a method for making an electronic device having such an antenna.

17 Claims, 10 Drawing Sheets

MULTIPROTOCOL ANTENNA, BT/WLAN EFFICIENCY

MULTIPROTOCOL ANTENNA, GPS EFFICIENCY

MULTIPROTOCOL ANTENNA FOR WIRELESS SYSTEMS

TECHNICAL FIELD

The example and non-limiting embodiments of this invention relate generally to wireless communication systems, methods, devices and computer programs and, more specifically, relate to an antenna for use in different radio technologies.

BACKGROUND

This section is intended to provide a background or context to the invention that is recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

Increasingly, mobile radio handsets incorporate multiple radios that operate over different protocols and different frequency bands. For example, it is typical that a new mobile handset is equipped with one or more of a global positioning system GPS receiver, a Bluetooth transceiver, a wireless local area network WLAN transceiver, and a traditional FM radio receiver. More prevalent currently in Europe and Asia than in the US, some mobile handsets also incorporate a radiofrequency identification RFID transceiver, which is often used for mobile electronic commerce when linked to a credit/debit card, for electronic keys (car, house, etc.), and/or for reading a passive RFID tag (e.g., interactive advertising). RFID has a viable signal range of about 10 centimeters and operates in the 13.56 MHz frequency band. All of these radios above can generally be considered as secondary radios, in contrast to a cellular transceiver which may be considered the primary radio of a mobile telephony handset. Note also that it is common for such handsets to have multiple primary radios (e.g., tri-band or quad-band) for communicating on different cellular protocols such as GSM (global system for mobile communications, or 3G), UTRAN (universal mobile telecommunications system terrestrial radio access network, or 3.5G), WCDMA (wideband code division multiple access), OFDMA (orthogonal frequency division multiple access), to name but a few examples.

Each of these radios must operate with an antenna tuned to the requisite frequency band. Typically, near-field communications (NFC, a regime in which RFID is a member), Bluetooth, WLAN, and GPS are implemented with separate antennas. Where the handset also includes an internal FM radio, typically there is also an internal FM receiver including antenna (FM-RX) and an internal FM transmitter with an antenna (FM-TX) that may be separate from the FM-RX antenna.

All of this hardware of course must be fit into a handheld-size package, of which the housing itself must either facilitate the proper antenna resonances or not interfere with such proper resonances. This problem of space is increasingly acute considering the current trend toward metallic handset housings/covers/casings as compared to plastic which was recently the most common material for mobile phone housings. Often in past handset layouts there was a separate antenna for Bluetooth and WLAN, for GPS, for NFC, and for FM radio (broadcast), as well as for the primary cellular radio(s). While the Bluetooth, WLAN and GPS antennas can be made quite small, the FM antenna(s) require much more space, particularly if they are implemented separately for receive RX and transmit TX events.

Specific implementations for multiplexing multiple radios into a single antenna are detailed at U.S. Pat. Nos. 6,950,410 and 7,376,440. Peter Lindberg and Andrei Kaikkonen describe, at an Internet publication entitled "BUILT-IN HANDSET ANTENNAS ENABLE FM TRANSCEIVERS IN MOBILE PHONES" (July, 2007), a FM transceiver antenna designed for a handset that is a single turn half-loop, shorted at one end and connected at the other to a co-designed preamplifier which also has a shunt capacitor for ac shorting at GSM frequencies.

SUMMARY

In one example embodiment of the invention there is provided an apparatus comprising an antenna; first, second and third feed ports; and an impedance. The first feed port and the second feed port define respective first and second ends of the antenna. The third feed port interfaces to the antenna at an intermediate point between the first and second ends of the antenna. The impedance is disposed along the antenna and configured such that in a first mode signals to or from the first and second feed ports resonate along the whole of the antenna and in a second mode signals to or from the third feed port resonate along a portion of the antenna, in which the portion terminates at the impedance.

In another example embodiment of the invention there is provided a method comprising: operatively coupling a first radio, which is configured to operate in a first frequency band, to an antenna via a first feed port and a second feed port that define respective first and second ends of the antenna. Further in the method at least a second radio, which is configured to operate in a second frequency band, is operatively coupled to the antenna via a third feed port that interfaces to the antenna at an intermediate point between the first and second ends of the antenna. The antenna comprises an impedance disposed along its length between the third feed port and the first feed port, and the impedance is configured to pass signals within the first frequency band and to block signals within the second frequency band.

DETAILED DESCRIPTION

Figure 1:
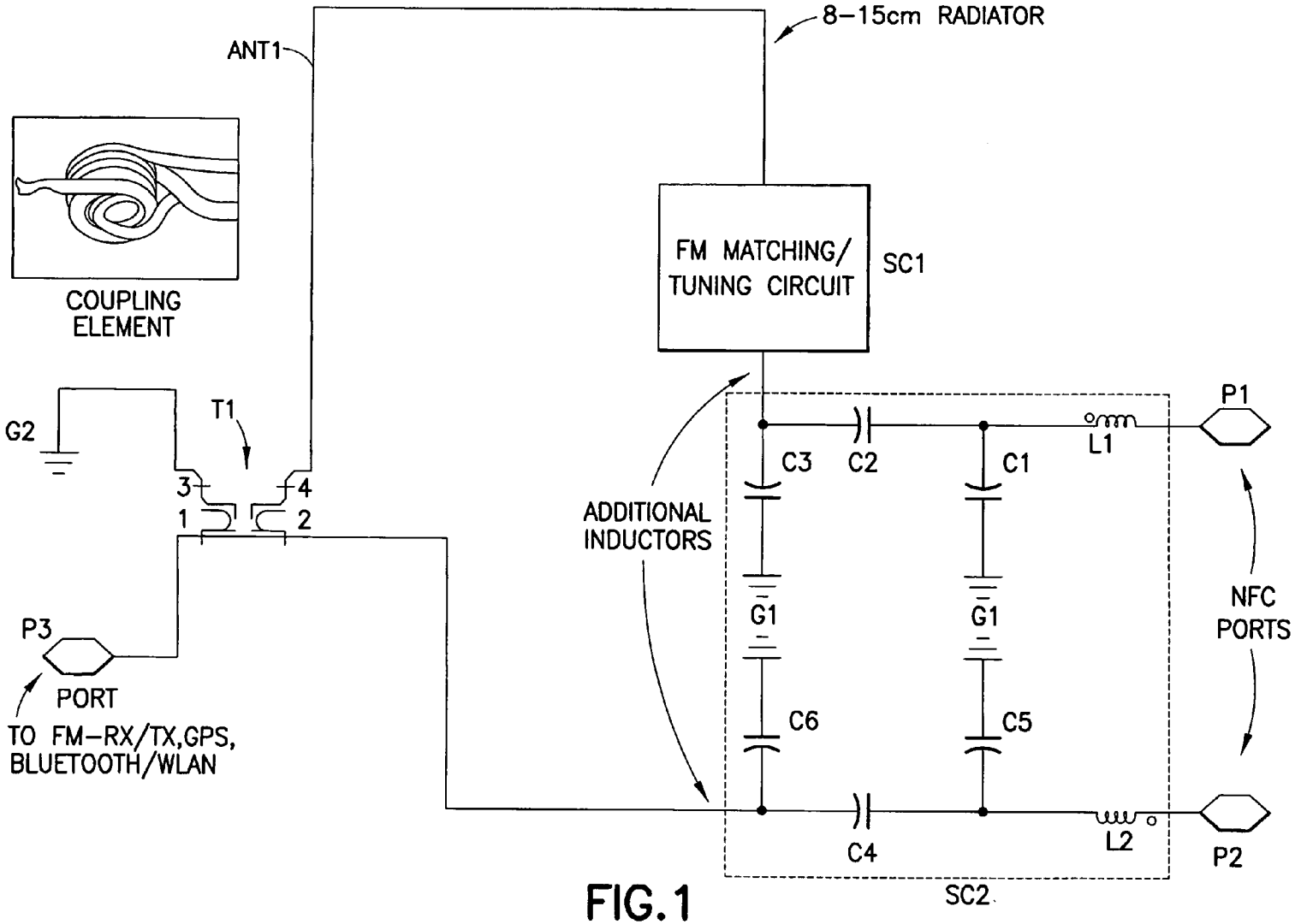
FIG. 1 is a schematic diagram illustrating a multiprotocol antenna and related circuitry for NFC, FM-RX, FM-TX, Bluetooth, WLAN, and GPS according to an example embodiment of the invention.

In the example embodiment of FIG. 1 which is detailed further below, there is a near-field communications antenna Ant1 which is used for RFID signals (NFC signals) and which is also used for far field signals such as for example GPS, Bluetooth, WLAN, and FM-RX/FM-TX. It should be appreciated by the skilled person that a near field antenna performs a "coupling" function only in the near field, rather than an antenna function in the far field as is known in the art. As will be detailed below, two important technical effects of these embodiments are that a) far field systems like FM-RX can be connected to the NFC loop type antenna without decreasing performance or interfering with any of the other systems (or at least such interference is sufficiently minimal); and b) other systems like GPS, Bluetooth and/or WLAN can also be connected to that same NFC antenna with similar minimal interference.

Separation of signals, for example from the different NFC and FM (-RX) systems, could be difficult without the use of filters and without losing at least partially some of the received or transmitted signal power. Even connecting only two disparate systems like NFC and FM-RX to the same antenna can be difficult, but the example embodiments detailed herein solve this problem in an elegant way which further enables the addition of other secondary radio systems to the antenna, such as for example any combination of one or more of Bluetooth, WLAN and GPS radios.

Example embodiments of the invention may be summarized as a single antenna which in its physical form has a first operational mode that is a balanced mode (for example, a loop antenna) and which also has a second operational mode in which a portion of the antenna operates as a linear radiating element (monopole or similar non-loop structure) in a second operational mode. The first operational mode may be considered to be a balanced mode, whilst the second operational mode may be considered to be an unbalanced mode. It is noted that in the antenna arts, linear does not imply geometrically straight but defines the antenna type: a monopole, a shorted monopole, a dipole, etc., any of which may be along a straight line or which may meander along the length of the radiating element of the overall antenna.

From this basic design are detailed suitable filters and switches which are used in the example embodiments to combine all of the above six radios (FM-TX, FM-RX, Bluetooth, WLAN, GSP, and RFID) into this single antenna so that only the NFC (RFID radio) utilizes the antenna in the balanced mode.

In certain of the example embodiment the technical effect is to eliminate the need for separate antennas for any of the additional five radios that prior art multi-radio handsets use. This may be important for mobile handsets having metallic covers/housings, which constrain antenna placement more than plastic housings. The end result is any combination of a reduced size of the overall handset, or reduced interference due to better placement of retained hardware, or additional features being placed in the handset due to the physical space saved by the multiprotocol antenna. Another technical effect is related to filters, of which prior art implementations might use many filters for separation of NFC and FM-RX bands, but which are not needed in these example embodiments.

The combination of antenna having two connection ports with filters and switches can be seen schematically at FIG. 1. A single bandpass filter BPF (or low pass filter LPF, shown explicitly at FIG. 4 and as sub-circuit SC1 at FIG. 1) may be used at one part of the antenna so that the antenna operates as a linear (or monopole type) antenna in all bands except the RFID band which uses the (whole) antenna to operate in the near field only. The other radio protocols or bands operate in the far field. In the first mode (for NFC or RFID signals) the antenna operates as a balanced antenna, whereas in the second mode (for any one or combination of Bluetooth/WLAN/GPS/FM signals or for any radio system requiring a linear or unbalanced antenna operating in both the near and far fields) the same antenna is configured as a single-ended (or unbalanced) antenna. The antenna can operate in both modes simultaneously.

Now consider FIG. 1 in detail. In this example embodiment the apparatus/circuit shown there includes an antenna Ant1 and a first feed port P1 and a second feed port P2 that define ends of the antenna Ant1. The antenna Ant1 is coupled to a FM-RX/FM-TX radio, a GPS radio, a Bluetooth radio and a WLAN radio via a third feed port P3. Example circuitry for distinguishing signals from those various radios is detailed below with reference to FIG. 3. The third feed port P3 interfaces to the antenna Ant1 at an intermediate point along the antenna Ant1 (intermediate being between the antenna's two ends). At FIG. 1 this intermediate interface point is a coupling element T1 shown by example as a transformer. The RFID radio interfaces to the antenna via the first feed port P1 and the second feed port P2 which define the ends of the antenna.

In the first mode, signals in the NFC band (RFID band, about 13.56 MHz) resonate about the entire antenna Ant1 and signals to and/or from the RFID radio pass through the first and second feed ports P1/P2. The coupling element T1 is configured so as to block signals in the NFC band from passing to the third feed port P3.

In the second mode, signals in the far field band(s) resonate only along a portion of the antenna Ant1 and signals to and/or from the far field radio(s) pass through the coupling element T1 and the third feed port P3. There is a filter which can also be termed an inductance, shown as a FM matching circuit or FM tuning circuit and designated sub-circuit SC1 at FIG. 1, which is configured so as to block signals in the far field band(s) from passing to the first feed P1. There is also a matching circuit, designated sub-circuit SC2, between the two NFC ports P1 and P2 which also blocks the far field signal (FM-RX/FM-TX in this case) from coupling to the first port P1. The matching circuit (sub-circuit SC2) may take many varied forms, but is shown at FIG. 1 as capacitors C1 and C5 coupling to ground G1 on a first crossover line and capacitors C3 and C6 coupling to ground G1 on a second crossover line in parallel with the first crossover line. The matching circuit SC2 also includes along the antenna Ant1 inductances L1 and L2, and capacitances C2 and C4 as shown at FIG. 1. It is inductance L2 that blocks signals in the far field band(s) (e.g., the FM-RX and FM-TX signals in the example embodiments of FIGS. 1-2) from coupling to the second feed port P2. Additional inductors apart from the matching circuit SC2, which are shown particularly at FIG. 2 as L3 and L4, block other signals in the far field band(s) (e.g., Bluetooth/WLAN/GPS) from reaching the first and second feed ports P1 and P2.

In an example embodiment the physical location along the antenna Ant1 of certain components relative to one another are tailored so that the length of that portion of the antenna Ant1 between such components is resonant in the operational frequency band of a far field radio which interfaces to that portion of the antenna Ant1. So for example, L2 and SC1 are positioned such that the length of the antenna Ant1 between them is resonant with the FM-RX band, and the FM-RX radio interfaces to that length of the antenna Ant1 at T1.

Figure 2:
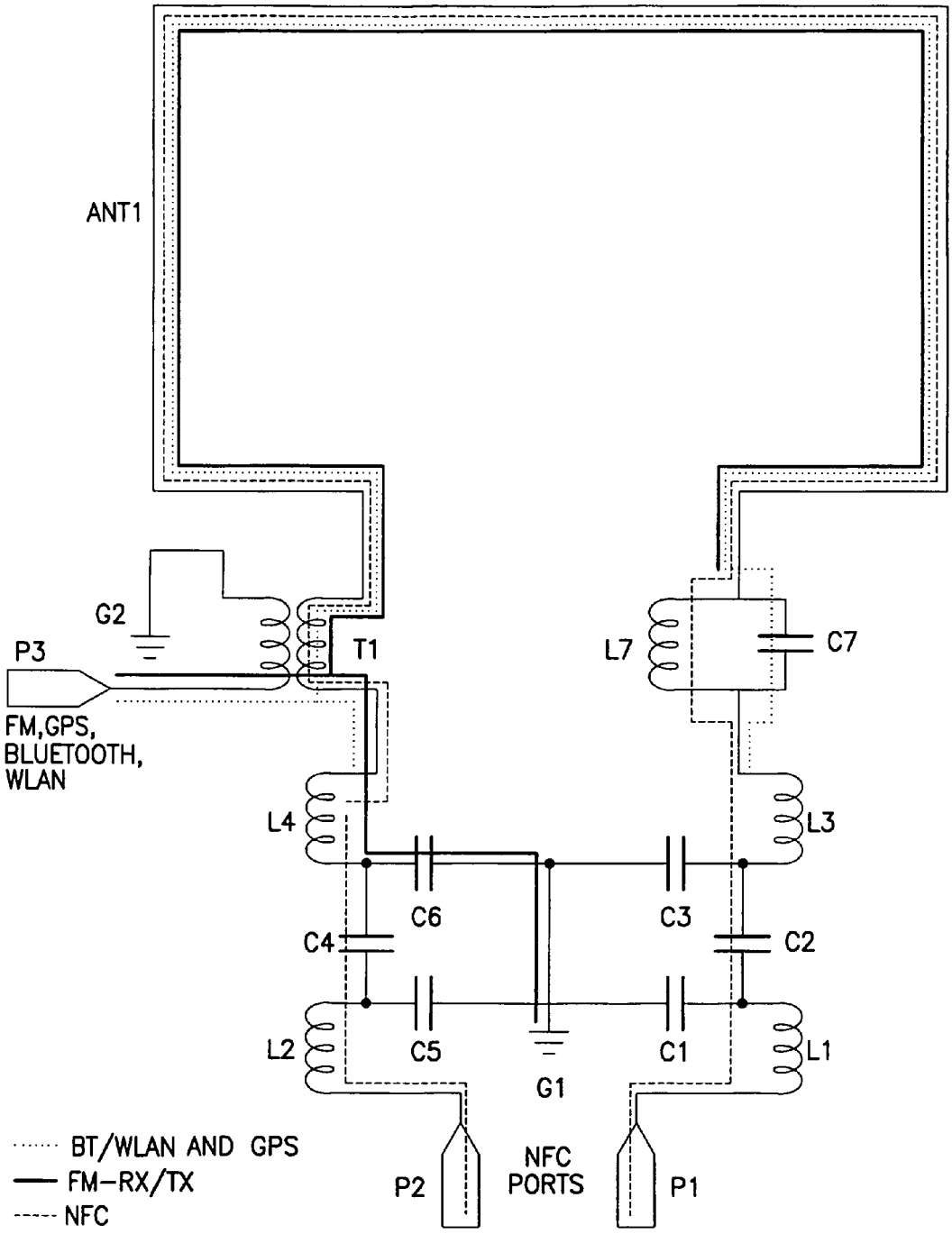
FIG. 2 is similar to FIG. 1 but showing further detail and different resonant paths about the antenna of the different radio frequency band radios according to an example embodiment of the invention.

As shown at FIG. 2, the FM tuning circuit SC1 of FIG. 1 can be, for example, one or more parallel inductor(s) and capacitor(s) arranged in what is commonly known as a LC tank circuit. Such a LC tank circuit can be used to form a resonance for the FM receive band. For the case where a low noise amplifier LNA is used for the FM-RX band at a position prior to the FM radio's interface T1 to the antenna Ant1 (see for example FIG. 3), such a LC tank circuit is optional because the radiator impedance in the second mode (far field) can be matched to the input impedance of the LNA with a shunt capacitor C9 as an alternative embodiment.

The FM tuning/matching circuit SC1 shown by example at FIG. 1 does not interfere with the NFC signal for the first mode, which goes undisturbed through the inductor coil L7 of the LC tank circuit embodiment of SC1 which is shown at FIG. 2. A similar truth holds for the Bluetooth/WLAN and/or GPS signals in the second mode, but in that case these signals pass undisturbed through the capacitor C7 of the LC tank circuit embodiment of SC1 (FIG. 2). But from the perspective of the FM signal, the parallel combination of capacitor C7 and inductor L7 of the LC tank circuit SC1 in series with the antenna Ant1 forms an electrical cut off. Different from the physical placement of the inductor L7 which was noted above to set the resonant length of the antenna for FM-RX between L2 and SC1, the electrical length of the FM antenna can be selected by tuning the capacitor C7 of the LC tank circuit SC1. Alternatively the FM tuning/matching circuit SC1 can have a fixed value capacitor and the FM antenna length is set according to the physical placement of the sub-circuit SC1 along the antenna Ant1 as noted above.

For the FIG. 1 embodiment which includes Bluetooth, WLAN and GPS as well as the FM transmit and receive radios, there are shown at FIG. 1 positions along the antenna Ant1 for two additional serial inductors which are configured to block the Bluetooth,WLAN and/or GPS signals from passing through to the NFC matching components (SC2, which includes inductors L1 and L2 and capacitors C2 and C4). These coils (shown at FIG. 1 only by their prospective positions) do not affect the performance or the impedance of the NFC signals or of the FM receive signals.

One technical effect of an example implementation of the coupling element T1 is that it enables the circuit/antenna shown at FIG. 1 to operate in both the first mode and in the second mode simultaneously. That is, NFC signals can be transmitted and/or received simultaneously with the transmission/reception of the Bluetooth, WLAN and/or GPS signals, using the same physical antenna Ant1.

In this embodiment the FM reception (FM-RX) signals and the FM transmit signals (FM-TX) are an exception to this simultaneous operation since typically these two radios do not need to operate simultaneously. However, any other combination of radios (Bluetooth, WLAN, GPS, and either TX or RX for FM) can operate simultaneously with the NFC (or RFID) radio.

The reason FM-RX and FM-TX signals need not be operational simultaneously in a mobile handset is explained by an example. It has become popular that personal digital music storage devices are used to provide content to a separate audio delivery system using broadcast FM signals. These broadcasts are exempt from airwave licensing requirements because they transmit with a very low power which severely limits range, for example to one or a few meters. For example, a user may tune the FM radio receiver in a car to a generally un-occupied frequency and broadcast music to that car radio from a low power FM transmitter coupled to one's personal digital music storage device. A user's mobile handset may combine the low power FM transmitter with the personal music storage for such a use. On the reception side, the user's handset may also be configured with a traditional broadcast FM receiver, which can be used to receive traditional FM broadcasts from a licensed radio station or from another low-power FM transmitter of a different handset. For the above case of FM transmissions then, there is no need for simultaneous FM reception by the same handset.

FIG. 2 is a schematic diagram of an example embodiment substantially similar to that of FIG. 1 but showing the exemplary resonant lengths of the antenna Ant1 for the various radios. As noted above, the first sub-circuit SC1 of FIG. 1 is shown as a LC tank circuit at FIG. 2 with inductor L7 and capacitor C7. Inductors L3, L4 and L7, as well as capacitor C7, are optional components of the antenna circuit, depending on how many different radios interface through the third feed port P3.

The NFC signals are received or transmitted through the NFC ports which are the first and second feed ports P1 and P2, and the NFC radio (not shown) is connected to those ports P1 and P2. The NFC signals are therefore resonant along the whole of the antenna Ant1 whose ends are defined by the two NFC ports P1 and P2. The coupling circuit T1 blocks the NFC signals from passing toward the third feed port P3. As shown at FIG. 2, the resonant length for the NFC signals spans from the first feed port P2 through inductance L2, capacitance C4, inductance L4, passes undisturbed along coupling circuit T1 (but not toward the third feed port P3), through the first sub-circuit SC1 illustrated as tank circuit with L7 and C7, through inductance L3, capacitance C2 and inductance L1 to the first feed port P1. The matching sub-circuit SC2, having capacitors C1, C3, C5 and C6, blocks the NFC signal from the ground port G1.

The FM-TX (transmit) and FM-RX (receive) signals interface to/from the antenna Ant1 via the third feed port P3 and the coupling element T1. The parameters/values of the inductances L7 and L4 and of the capacitances C4 and C6 are designed such that the FM signal resonates along only a portion of the whole antenna Ant1, and so therefore the antenna for the FM signals is not operating as a loop antenna but rather a linear, single-ended or unbalanced antenna. As above, these parameters can be fixed and the resonant length is set by physical positioning along the antenna Ant1, or they may be variable and the electrical length is controlled by a processor/controller that varies the parameter (inductance, capacitance) to set the resonant length for the second mode based on which radio that interfaces at T1 is in operation. For the example implementation of FIG. 2, the FM signals radiate along a shorted monopole, which is shorted at G1 and which passes through C6, L4 and T1, around the antenna Ant1, and terminates at the inductance L7 of the LC tank circuit SC1.

The remaining radios are Bluetooth, WLAN and GPS. Like the FM signals, these also interface to the antenna Ant1 to and from the coupling element T1 via the third feed port P3. The parameters/values of the inductances L4, L7 and L3, and of the capacitance C7, are designed such that the Bluetooth, WLAN and GPS signals resonate along a portion of the whole antenna Ant1 that is an unshorted monopole, also a type of linear antenna. For the example implementation of FIG. 2, the Bluetooth, WLAN and GPS signals radiate along the portion between inductance L4 and inductance L3, passing through the coupling element T1 and the LC tank capacitor C7.

Following the embodiment of FIG. 2, the first mode can be considered to comprise signals in a first frequency band (NFC band), while the second mode can be considered to comprise signals in a second frequency band (any one or more of the bands for Bluetooth, WLAN and GPS) and also signals in a third frequency band (FM TX and/or RX bands). There is a first impedance L7 and a second impedance L3 arranged serially along the antenna Ant1. The first impedance L7 is configured to pass signals in the first (NFC) and second (Bluetooth/WLAN/GPS) frequency bands and to block signals in the third frequency band (FM) from reaching the second impedance L3. The second impedance L3 is configured to pass signals in the first frequency band (NFC) and to block signals in the third frequency band (FM).

Figure 3:
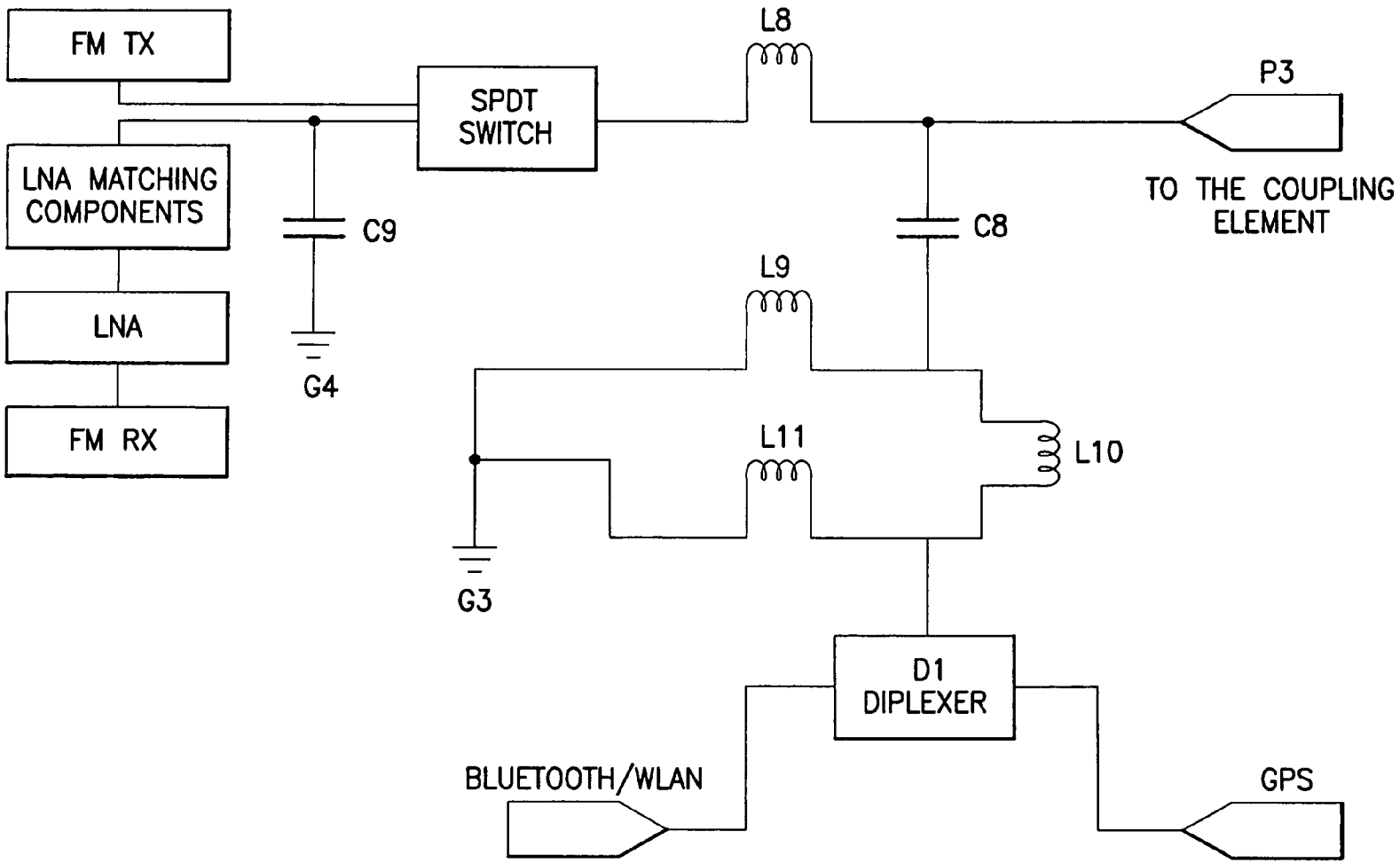
FIG. 3 is a schematic diagram illustrating a discriminating circuit by which a FM radio, a Bluetooth/WLAN radio, and a GPS radio may be coupled to a common third port shown by example at FIG. 1 according to an example embodiment of the invention.

FIG. 3 is a sub-circuit showing an example embodiment of how both FM radios, the Bluetooth and/or WLAN radio and the GPS radio interface to the third feed port P3. High-pass type dualband matching, via the inductances L11 and L10/L09 to ground G3, is used before the diplexer D1 to form two resonances, one for the GPS radio and one for the Bluetooth/WLAN radio. The capacitance C8 is designed/selected so as to block FM signals going to the diplexer D1. Similarly, the inductance L8 is designed/selected to block the Bluetooth/WLAN and GPS signals going to the FM port.

In one variation of FIG. 3, the FM transmitter and receiver are both coupled at the position of the illustrated switch. That embodiment is implemented with the LC tank circuit C7/L7 along the antenna Ant1 shown at FIG. 2. In a variation illustrated at FIG. 3, there is an electronically controlled switch (illustrated as single pole double throw, SPDT) which switches between FM-RX and FM-TX because these systems do not need to operate simultaneously at least for the example use case detailed above. This illustrated embodiment can be implemented without the LC tank circuit of FIG. 2, because the shunt capacitor C9 is selected to match the radiator impedance in the second mode (far field) to the input impedance of the low noise amplifier LNA. There may also be additional LNA matching components as illustrated, such as for example an electrostatic discharge ESD diode.

Figure 4:
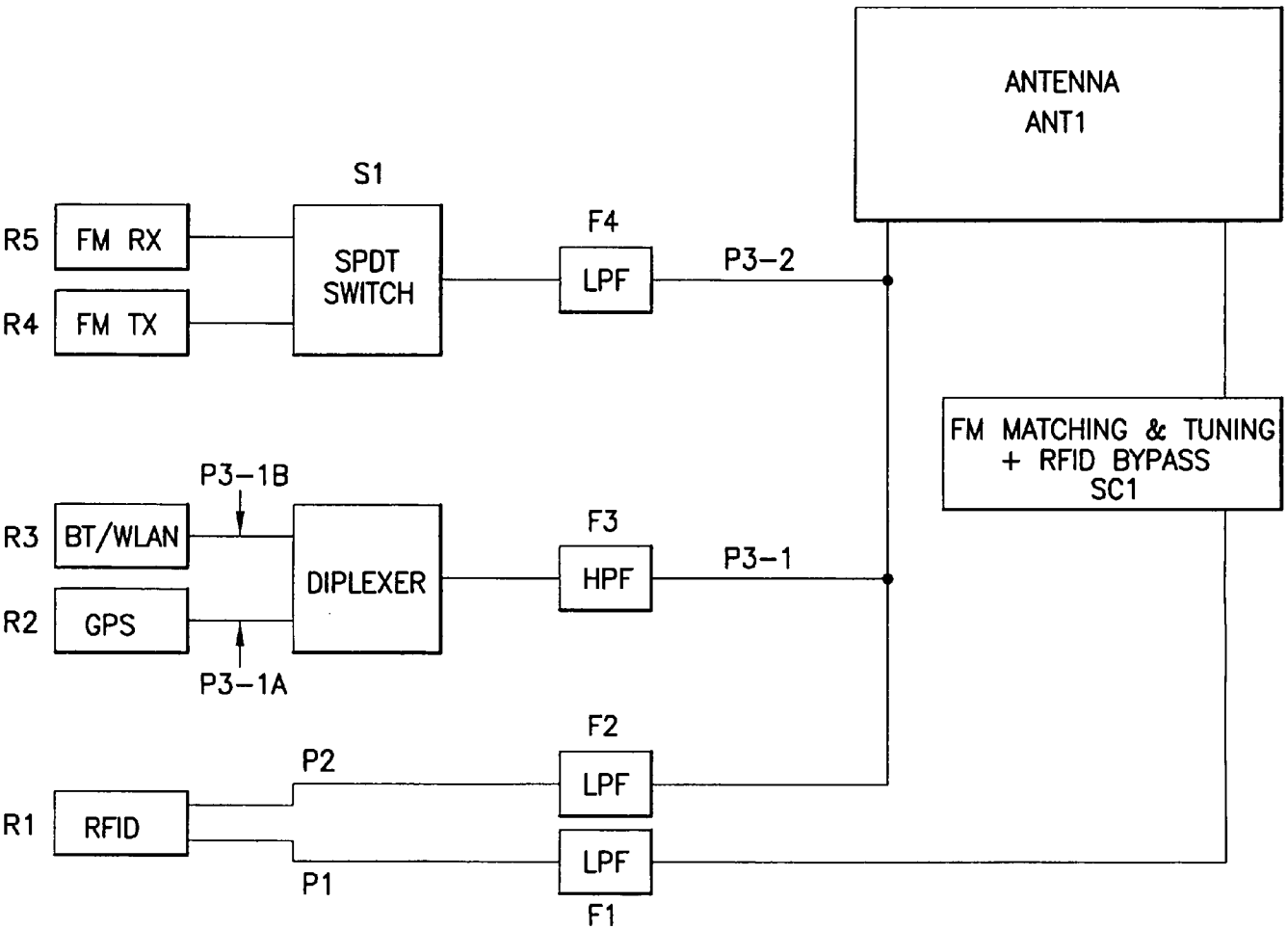
FIG. 4 is a simplified version of the antenna and related circuitry shown at FIG. 1 according to an example embodiment of the invention.

FIG. 4 illustrates a broad overview of an example embodiment according to the above teachings. Five radios are shown of which the FM TX and FM RX are shown separately. In this example, R1 is the RFID radio, R2 is the GPS radio, R3 is shown as either or both of the Bluetooth and/or WLAN radio, R4 is the FM transmitter, and R5 is the FM receiver. That which is illustrated at FIG. 4 as the antenna Ant1 (operating as a loop or coil antenna) is in truth only a portion of the antenna; the full loop length of the antenna runs between ports P1 and P2 at which the RFID radio R1 interfaces.

There is a low pass filter F1 disposed along the antenna between the first feed port P1 and the first sub-circuit SC1 which in FIG. 4 is a FM matching & tuning circuit combined with a RFID bypass which allows the RFID signal to pass uninterrupted. At FIGS. 1-2 this first filter F1 is illustrated as an inductance L3.

There is another low pass filter F2 disposed along the antenna between the second feed port P2 and the third feed port, shown at FIG. 4 separately as P3-1 and P3-2. The low pass filter F2 blocks Bluetooth, WLAN, GPS and FM signals (both RX and TX) and allows RFID signals to pass. At FIGS. 1-2 this first filter F2 is illustrated as an inductance L4 as to the Bluetooth/WLAN/GPS signals and as a capacitance C4 as to the FM signals.

There is a high pass filter F3 at the feed port P3-1 at which the Bluetooth/WLAN/GPS radios R2 and R3 interface with the antenna, which blocks both RFID signals and FM signals but which allows the Bluetooth/WLAN/GPS signals to pass. This is illustrated as the capacitance C8 at FIG. 3, and as the coupling element T1 at FIGS. 1-2.

There is yet another low pass filter F4 at the feed port P3-2 at which the FM radios R4 and R5 interface with the antenna, which blocks both RFID signals and also all of the Bluetooth/WLAN/GPS signals but which allows the FM TX and RX signals to pass. This is illustrated as the inductance L8 at FIG. 3, and as the coupling element T1 at FIGS. 1-2. It is clear that each of the filters F1 through F4 impose an impedance.

Figure 5A:
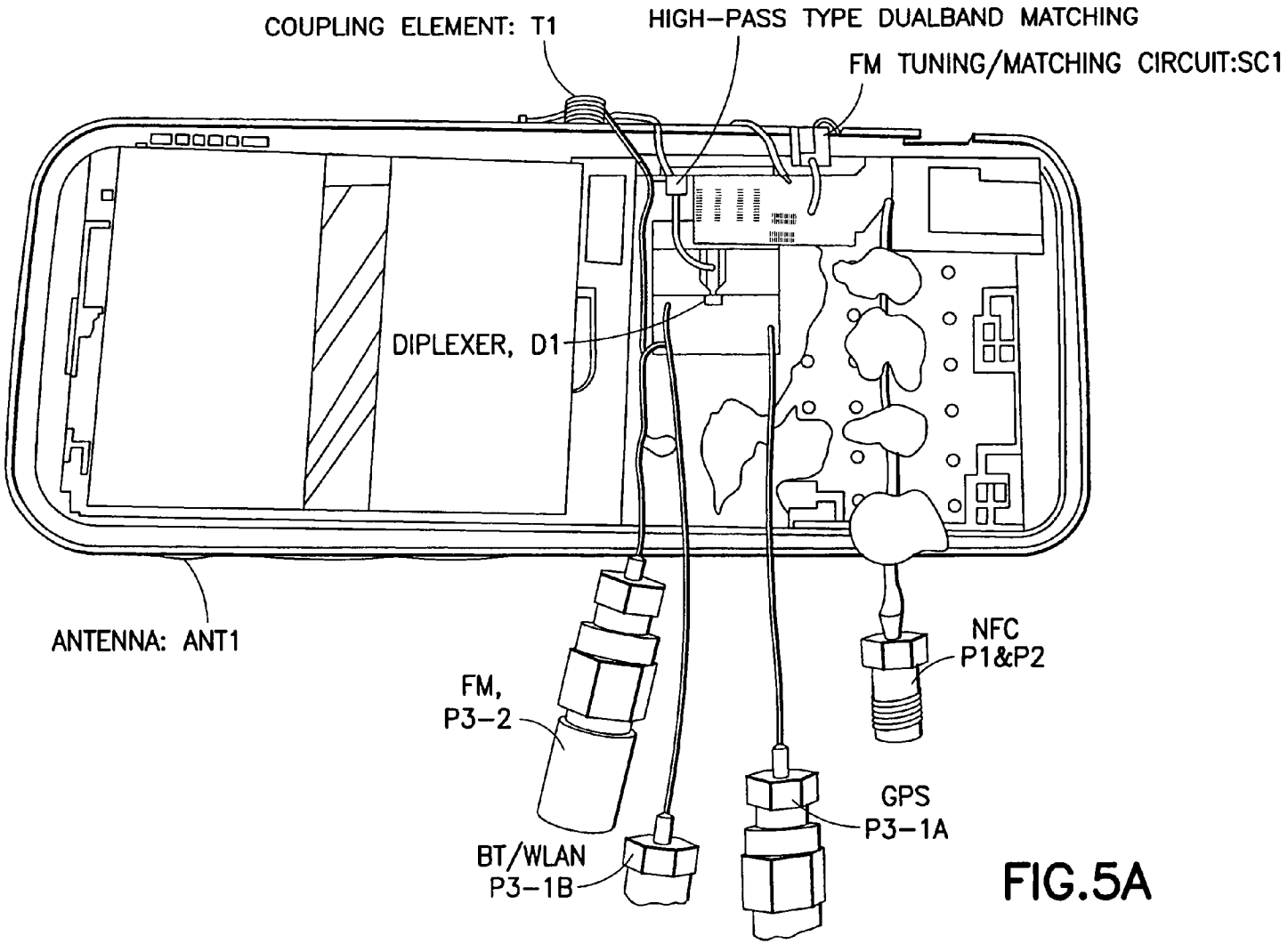
FIG. 5A is a front-side image of internals of a handset configured with an example embodiment of the invention that was reduced to practice and set up for testing the embodiment.
Figure 5B:
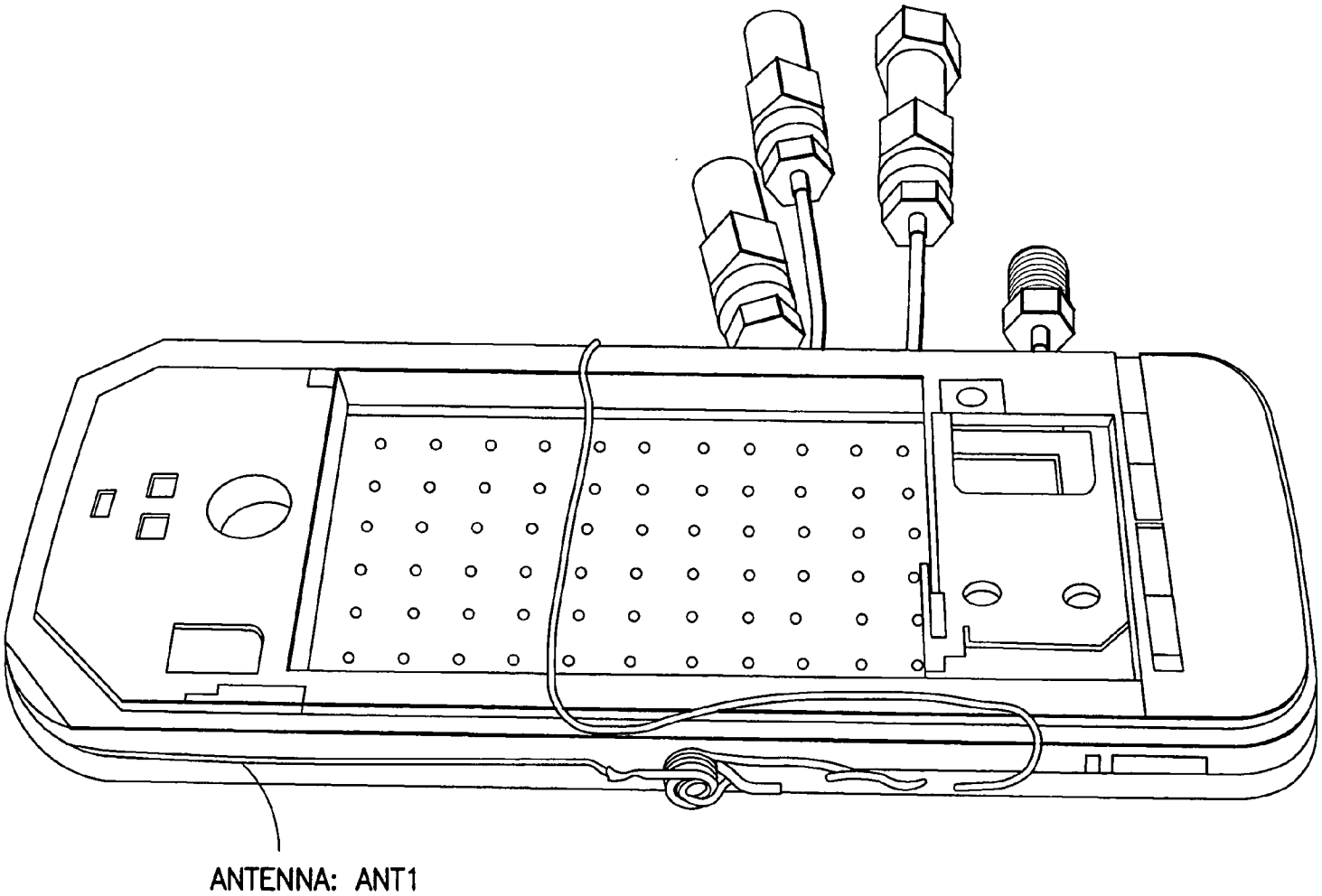
FIG. 5B is a reverse-side image of the handset from FIG. 5A.

FIGS. 5A-5B are illustrations of opposed sides of a mobile handset configured with an example embodiment of the invention. Shown are the diplexer D1, coupling element T1, dual band matching sub-circuit (L9/L10/L11 and G3 of FIG. 3) and the antenna Ant1 itself configured about a periphery of the handset housing. Also shown are enlarged feed ports for FM at P3-2, separate feed ports for Bluetooth/WLAN at P3-1*a* and for GPS at P3-1*b*, and a single fitting for both RFID feed ports P1 and P2. FIG. 5B more clearly illustrates from the reverse angle the configuration of the radiating element Ant1 itself.

Figure 6A:
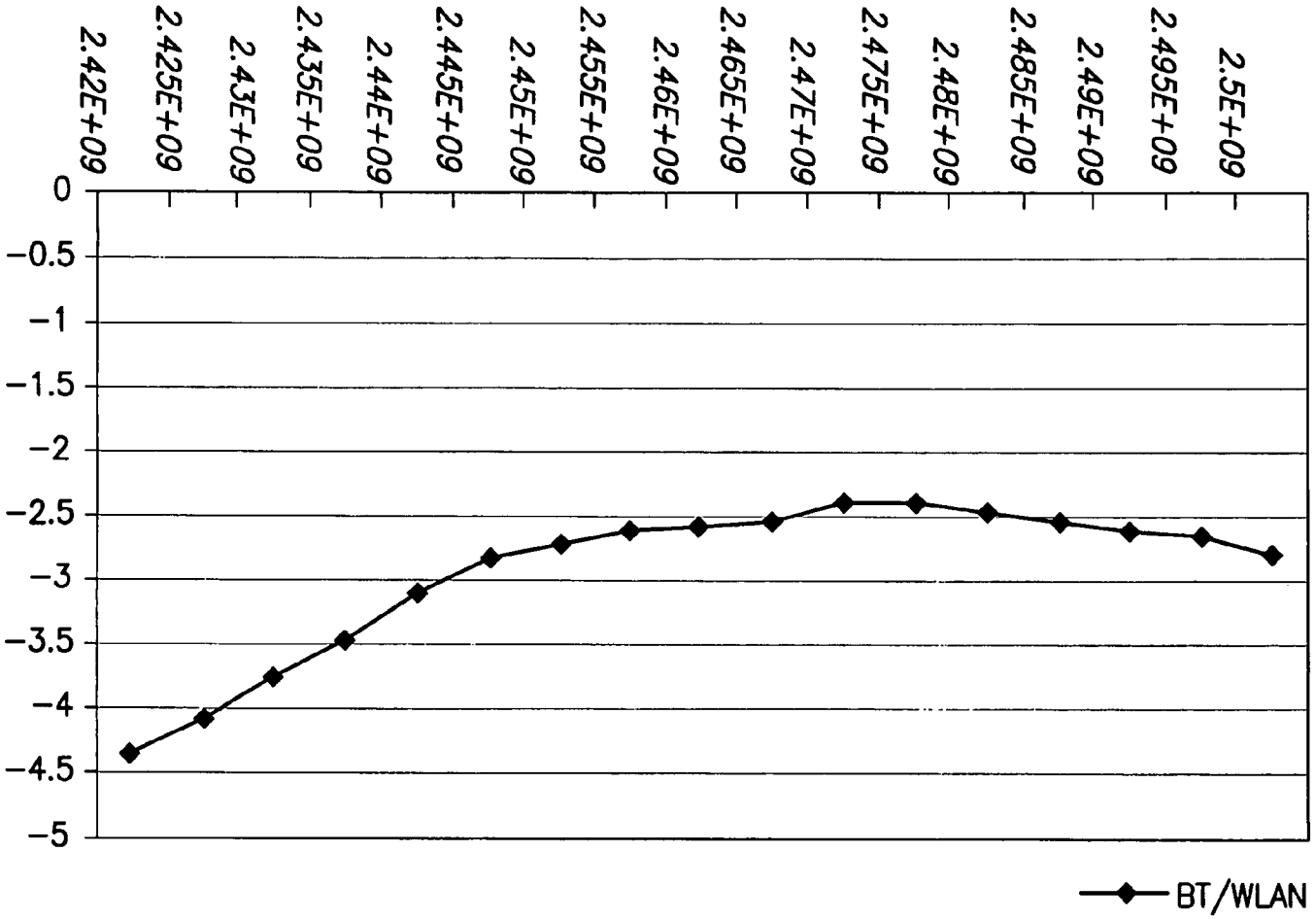
FIGS. 6A-B quantify graphically test results for the handset of FIGS. 5A-B for Bluetooth/WLAN efficiency and GPS efficiency, respectively, while simultaneously receiving a RFID signal.
Figure 6B:
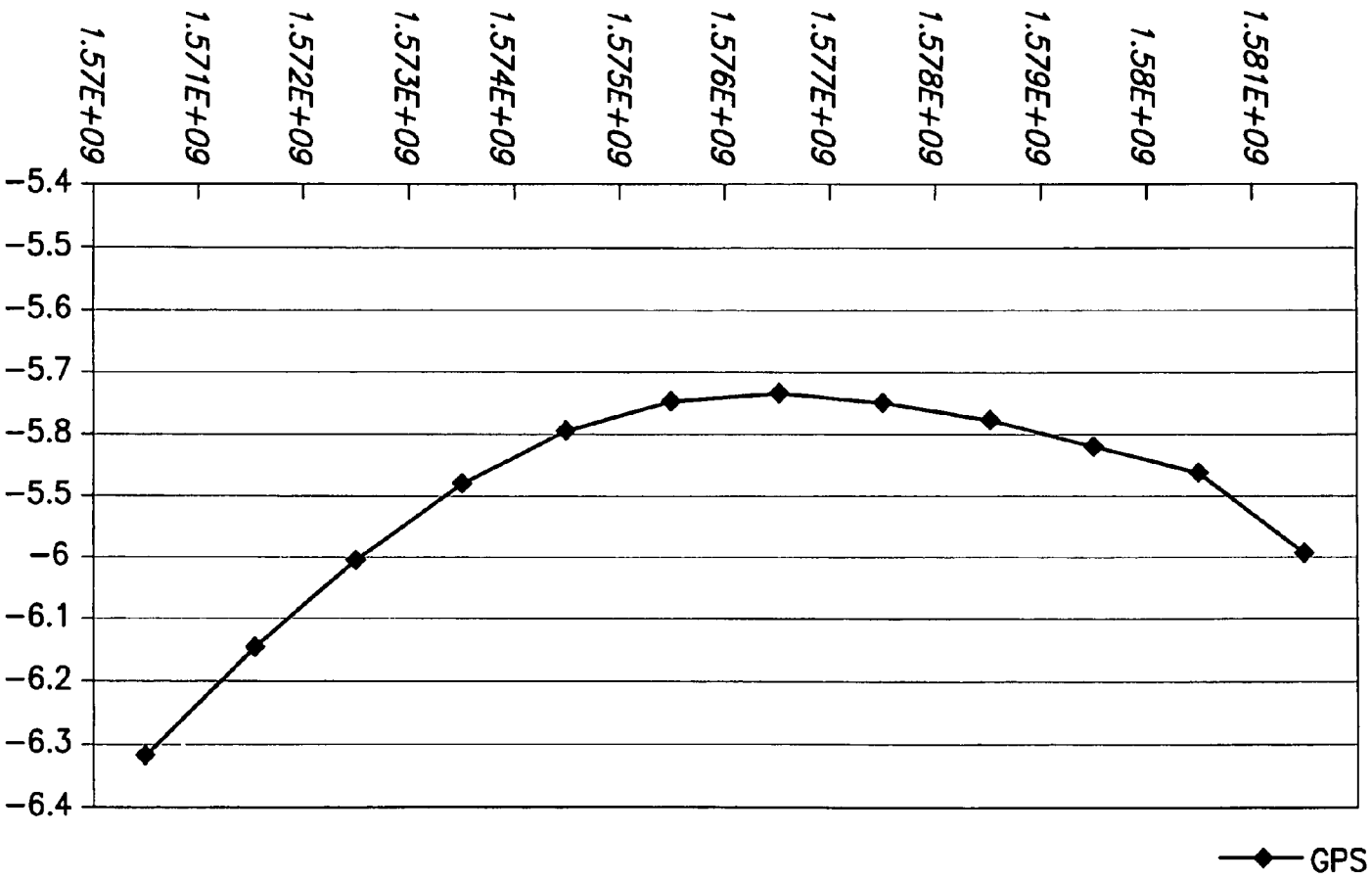

FIGS. 6A-B illustrate examples of graphically quantitative results from the test apparatus shown at FIGS. 5A-B. For each an RFID tag was read out to test simultaneous operation in the first and second mode, in which for FIG. 6A the second mode had the Bluetooth/WLAN radio operating and for FIG. 6B the second mode had the GPS radio operating. FIGS. 6A-B show that good efficiencies can be achieved from that tested embodiment of the multiprotocol antenna, and we conclude from them that the RFID readout distance is about 30-40 mm.

We note two qualifications to the test data at FIGS. 6A-B. The internal FM performance was on the same level as with the bare FM-RX solution; that is, there was negligible interference from simultaneous RFID operation as compared to FM-RX operation alone. Also, the results posted at FIGS. 6A-B are about 1 dB worse than actual, due to the measurement equipment. The inventors tested and confirmed this level of degradation, so actual results should be improved over FIGS. 6A-B by about 1 dB. The results at FIGS. 6A-B also include a loss of 0.5 dB caused by the diplexer D1. Additionally, it is reasonable that the long feeding lines to the printed wiring board shown at FIGS. 5A-B cause further losses in the FIG. 6A-B data. For GPS, even −2 dB efficiencies were measured but using a different embodiment for the matching circuitry than is illustrated in the FIG. 1-2 schematics.

From the above it will be appreciated that according to an example embodiment of the invention there is an apparatus that comprises an antenna Ant1; a first feed port P1 defining a first end of the antenna and a second feed port P2 defining a second end of the antenna; a third feed port P3 coupled to an intermediate point T1 along the antenna (between the first and second ends); an impedance L3 disposed along the antenna and configured such that in a first mode signals (RFID) to or from the first and second ports resonate along the whole of the antenna and in a second mode signals (any one or more of Bluetooth/WLAN/GPS/FM) to or from the third port resonate along a portion of the antenna in which the portion terminates at the impedance.

In one example embodiment of the above apparatus, the propagated signals (those transmitted from or received at the antenna) in the first mode may consist of near field signals having an average range of less than one meter and the propagated signals in the second mode may consist of far and/or near field signals having an average range of at least five meters.

In another example embodiment of the above apparatus, the propagated signals in the first mode may comprise radio-frequency identification RFID signals and the propagated signals in the second mode may comprise at least one of Frequency Modulation (FM) radio signals, global positioning system (GPS) signals, Bluetooth signals, and wireless local area network (WLAN) signals.

In another example embodiment of the above apparatus, the propagated signals in the first mode may define a first frequency band and the propagated signals in the second mode may define a second frequency band different to the first frequency band.

In another example embodiment of the above apparatus, the first mode and the second mode may be active simultaneously.

In another example embodiment of the above apparatus, the first mode is such that the antenna may operate as a balanced antenna and the second mode is such that the antenna may operate as an unbalanced antenna.

In another example embodiment of the above apparatus, the apparatus may further comprise a RFID radio that is operatively coupled to the antenna via the first and second port and no other radios are operatively coupled to the antenna via the first and/or second ports, and a plurality of non-RFID radios that are operatively coupled to the antenna via the third radio port. As used herein, a radio that is operatively coupled to the antenna is arranged to receive input signals from the antenna which the antenna wirelessly received from some other source apart from the radio, and/or to arrange to provide output signals to the antenna for wireless transmission from the antenna.

In another example embodiment of the above apparatus, the impedance may comprise one of a band pass filter or a low pass filter configured to pass signals in the first mode and to block signals in the second mode.

In another example embodiment of the above apparatus, the signals in the first mode may comprise signals in a first frequency band (RFID band), and signals in the second mode may comprise signals in a second frequency band (any one or more of Bluetooth/WLAN and GPS) and signals in a third frequency band (any one or more of FM RX and TX). The first, second and third frequency bands are all different from one another. In this example embodiment the impedance may comprise a first impedance L7 and a second impedance L3 arranged serially along the antenna, in which the first impedance is configured to pass signals in the first and second frequency bands and to block signals in the third frequency band from reaching the second impedance; and the second impedance is configured to pass signals in the first frequency band and to block signals in the third frequency band.

In another example embodiment of the above apparatus, the first impedance may comprise a LC tank circuit.

In another example embodiment of the above apparatus, the second impedance may comprise an inductor.

In another example embodiment, the above apparatus is disposed within a wireless handset device which may further comprise: a RFID radio operatively coupled to the antenna via the first and the second feed ports; at least one of a FM radio, a Bluetooth radio, a wireless local area network radio and a global positioning system radio operatively coupled to antenna via the third feed port; and a cellular radio operatively coupled to a cellular antenna that is separate from the antenna.

According to another example embodiment of the invention there is an apparatus that may comprise antenna means (Ant1); first and second feeding means (P1 and P2) by which the antenna means operates as a balanced antenna (for example, as a loop antenna); third feeding means by which the antenna operates as an unbalanced antenna (for example, as a linear antenna); and filtering means (L3, SC1) for enabling the antenna means to operate as a balanced antenna for signals within a first frequency band (for example, RFID signals) and to operate as an unbalanced antenna for signals within at least a second frequency band (for example, any one or more of Bluetooth/WLAN/GPS/FM signals).

Figure 7:
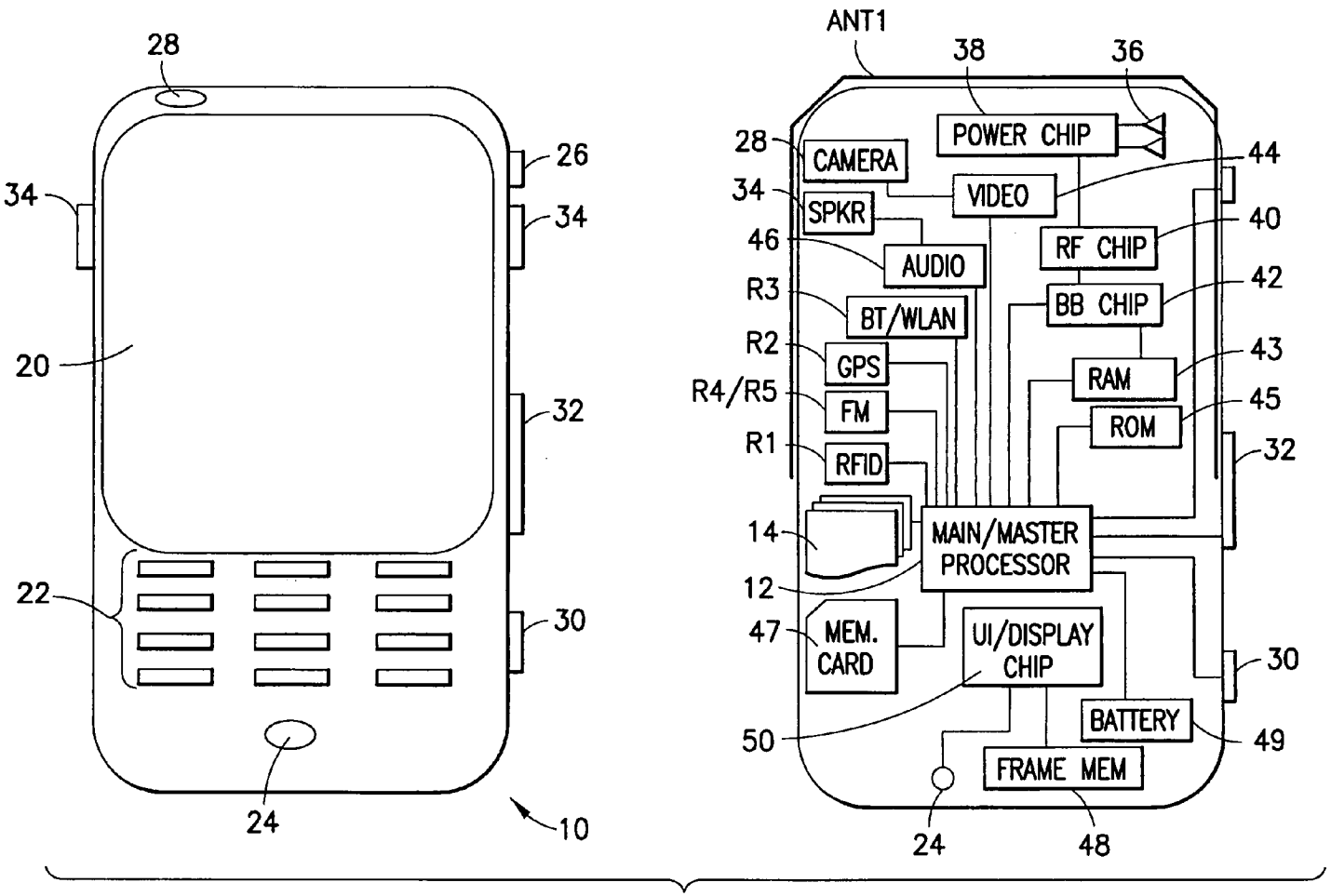
FIG. 7 is a schematic diagram in plan view (left) and sectional view (right) of a mobile handset according to an example embodiment of the invention.

A multiprotocol antenna according to the example embodiments may be disposed in a mobile station such as the one shown at FIG. 7, also termed a user equipment (UE) 10. In general, the various embodiments of the UE 10 can include, but are not limited to, cellular telephones, personal digital assistants (PDAs) having wireless communication capabilities, portable computers having wireless communication capabilities, image capture devices such as digital cameras having wireless communication capabilities, gaming devices having wireless communication capabilities, music storage and playback appliances having wireless communication capabilities, Internet appliances permitting wireless Internet access and browsing, as well as portable units or terminals that incorporate combinations of such functions.

There are several computer readable memories 14, 43, 45, 47, 48 illustrated there, which may be of any type suitable to the local technical environment and may be implemented using any suitable data storage technology, such as semiconductor based memory devices, flash memory, magnetic memory devices and systems, optical memory devices and systems, fixed memory and removable memory. The digital processor 12 may be of any type suitable to the local technical environment, and may include one or more of general purpose computers, special purpose computers, microprocessors, digital signal processors (DSPs) and processors based on a multicore processor architecture, as non-limiting examples.

Further detail of an example UE is shown in both plan view (left) and sectional view (right) at FIG. 7. The UE 10 has a graphical display interface 20 and a user interface 22 illustrated as a keypad but understood as also encompassing touch-screen technology at the graphical display interface 20 and voice-recognition technology received at the microphone 24. A power actuator 26 controls the device being turned on and off by the user. The example UE 10 may have a camera 28 which is shown as being forward facing (e.g., for video calls) but may alternatively or additionally be rearward facing (e.g., for capturing images and video for local storage). The camera 28 is controlled by a shutter actuator 30 and optionally by a zoom actuator 32 which may alternatively function as a volume adjustment for the speaker(s) 34 when the camera 28 is not in an active mode.

Within the sectional view of FIG. 7 are seen multiple transmit/receive antennas 36 that are typically used for cellular communication and in the example embodiments detailed above are separate and distinct from the multiprotocol antenna detailed herein. These antennas 36 may be multiband for use with multiple cellular radios in the UE, or single band for a single cellular radio using MIMO transmission techniques. In an embodiment the power adjusting function of the power chip 38 noted below may be incorporated within the RF chip 40 (such as by amplifiers and related circuitry), in which case the antennas 36 interface to the RF chip 40 directly. The UE 10 may have only one cellular antenna 36. The operable ground plane for the antennas 36 is shown by shading as spanning the entire space enclosed by the UE housing though in some embodiments the ground plane may be limited to a smaller area, such as disposed on a printed wiring board on which the power chip 38 is formed. The ground plane for the multiprotocol antenna according to these teachings may be common with the ground plane used for the cellular antennas, or it may be separate and distinct physically even if coupled to the same ground potential. The ground plane may be disposed on one or more layers of one or more printed wiring boards within the UE 10, and/or alternatively or additionally the ground plane may be formed from a solid conductive material such as a shield or protective case or it may be formed from printed, etched, moulded, or any other method of providing a conductive sheet in two or three dimensions. The power chip 38 controls power amplification on the channels being transmitted and/or across the cellular antennas 38 that transmit simultaneously where spatial diversity is used, and amplifies the received signals. The power chip 38 outputs the amplified received signal to the radio-frequency (RF) chip 40 which demodulates and downconverts the various signals for baseband processing. The baseband (BB) chip 42 detects the signal which is then converted to a bit-stream and finally decoded. Similar processing occurs in reverse for signals generated in the apparatus 10 and transmitted from it.

The secondary radios (Bluetooth/WLAN shown together as R3, RFID shown as R1, GPS shown as R2, and FM shown as R4/R5) may use some or all of the processing functionality of the RF chip 40, and/or the baseband chip 42. The antenna Ant1 is shown as wrapping partially about a periphery of the housing as was illustrated at FIG. 5A-B, but this is but an example embodiment to obtain a loop length of the order of 8-15 cm as shown at FIG. 1; other embodiments for placement of the antenna Ant1 are not excluded. Due to the crowded diagram, ports, circuitry, and filters are not illustrated at FIG. 7 but the teachings arising from the example embodiments at FIGS. 1-5B give examples as to those components, wherever they may be physically disposed within the overall UE 10.

Signals to and from the camera 28 pass through an image/video processor 44 which encodes and decodes the various image frames. A separate audio processor 46 may also be present controlling signals to and from the speakers 34 and the microphone 24. The graphical display interface 20 is refreshed from a frame memory 48 as controlled by a user interface chip 50 which may process signals to and from the display interface 20 and/or additionally process user inputs from the keypad 22 and elsewhere.

Throughout the apparatus are various memories such as random access memory RAM 43, read only memory ROM 45, and in some embodiments removable memory such as the illustrated memory card 47 on which various programs of computer readable instructions are stored. Such stored software programs may for example set the capacitance of the capacitor C7 for the case that a variable capacitor C7 is employed in an example embodiment, in correspondence with transmit and/or receive schedules of the secondary radios. All of these components within the UE 10 are normally powered by a portable power supply such as a battery 49.

The aforesaid processors 38, 40, 42, 44, 46, 50, if embodied as separate entities in a UE 10, may operate in a slave relationship to the main processor 12, which may then be in a master relationship to them. Any or all of these various processors of FIG. 7 access one or more of the various memories, which may be on-chip with the processor or separate therefrom.

Note that the various chips (e.g., 38, 40, 42, etc.) that were described above may be combined into a fewer number than described and, in a most compact case, may all be embodied physically within a single chip.

Figure 8:
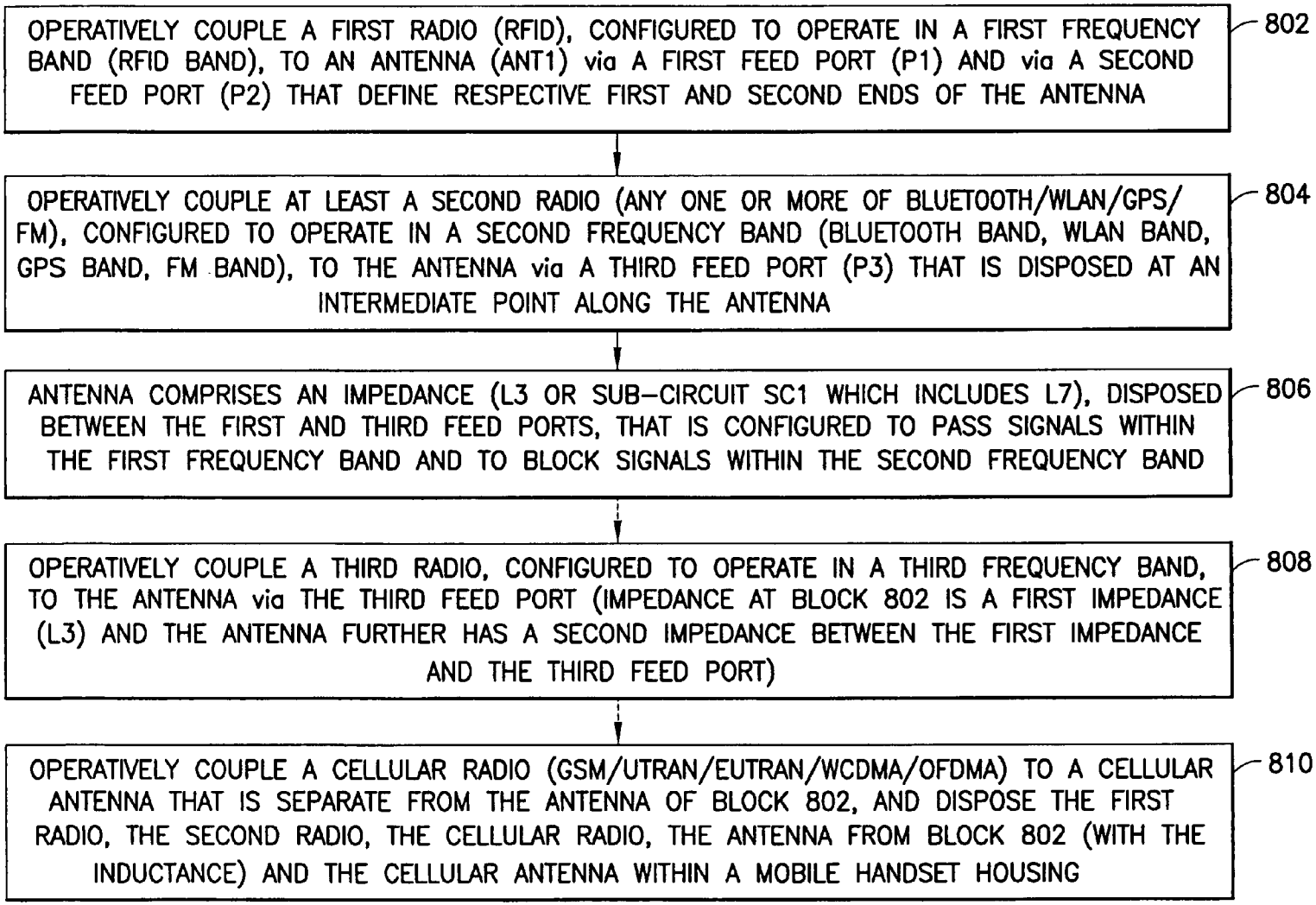
FIG. 8 is a logic flow diagram that illustrates the operation of a method, and a result of execution of computer program instructions embodied on a computer readable memory, in accordance with an example embodiment of the invention.

FIG. 8 is a logic flow diagram that illustrates the operation of a method for making an electronic apparatus in accordance with the example embodiments of this invention. Such an example and non-limiting method may comprise operatively coupling a first radio (e.g., RFID) configured to operate in a first frequency band (e.g., RFID band) to an antenna (Ant1) via a first feed port (P1) and a second feed port (P2) that define respective first and second ends of the antenna at block 802. Further in the method at block 804, at least a second radio (e.g., any one or more of Bluetooth/WLAN/GPS/FM) configured to operate in a second frequency band (e.g., Bluetooth band, WLAN band, GPS band, FM band) is operatively coupled to the antenna via a third feed port (P3) that is disposed at an intermediate point along the antenna. Block 806 gives the condition that the antenna comprises an impedance (L3 or sub-circuit SC1 which includes L7), disposed along the antenna between the third feed port and the first feed port, which is configured to pass signals within the first frequency band and to block signals within the second frequency band.

In an example embodiment of the above method, no radio apart from the first radio is operatively coupled to the antenna via both the first and the second feed ports, and there are a plurality of radios that are operatively coupled to the antenna via the third feed port.

In another example embodiment of the above method, the method further may comprise at block 808 operatively coupling a third radio (any others of the Bluetooth/WLAN/GPS/FM radios) configured to operate in a third frequency band to the antenna via the third feed port. In this instance the above-mentioned impedance comprises a first impedance (L3) and the antenna further comprises a second impedance (L7 within the LC tank circuit SC1) arranged along the antenna serially with the first impedance between the first impedance and the third feed port. The first impedance (L3) is configured to pass signals in the first frequency band (RFID signals) and to block signals in the second frequency band (Bluetooth/WLAN/GPS signals), and the second impedance is configured to pass signals in the first frequency band (RFID signals) and to block signals in the third frequency band (FM signals) from reaching the second impedance.

In another example embodiment of the above method, the method may be directed to making a mobile handset. In this example embodiment there may be the further step at block 810 of operatively coupling a cellular radio (GSM/UTRAN/EUTRAN/WCDMA/OFDMA for example) to a cellular antenna separate from the antenna and disposing the first radio, the second radio, the cellular radio, the antenna with the inductance, and the cellular antenna within a mobile handset housing. In this context, the term cellular means wireless mobile telephony which uses a hierarchical network.

The various blocks shown in FIG. 8 may be viewed as method steps, and/or as operations that result from operation of computer program code, and/or as a plurality of coupled logic circuit elements constructed to carry out the associated function(s). It should be appreciated that although the blocks shown in FIG. 8 are in a specific order of steps that these steps may be carried out in any order or even some of the steps may be omitted as required.

In general, the various example embodiments may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the example embodiments of this invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

It should thus be appreciated that at least some aspects of the example embodiments of the inventions may be practiced in various components such as integrated circuit chips and modules, and that the example embodiments of this invention may be realized in an apparatus that is embodied as an integrated circuit. The integrated circuit, or circuits, may comprise circuitry (as well as possibly firmware) for embodying at least one or more of a data processor or data processors, a digital signal processor or processors, baseband circuitry and radio frequency circuitry that are configurable so as to operate in accordance with the example embodiments of this invention.

Various modifications and adaptations to the foregoing example embodiments of this invention may become apparent to those skilled in the relevant arts in view of the foregoing description, when read in conjunction with the accompanying drawings. However, any and all modifications will still fall within the scope of the non-limiting and example embodiments of this invention.

It should be noted that the terms "connected," "coupled," or any variant thereof, mean any connection or coupling, either direct or indirect, between two or more elements, and may encompass the presence of one or more intermediate elements between two elements that are "connected" or "coupled" together. The coupling or connection between the elements can be physical, logical, or a combination thereof. As employed herein two elements may be considered to be "connected" or "coupled" together by the use of one or more wires, cables and/or printed electrical connections, as well as by the use of electromagnetic energy, such as electromagnetic energy having wavelengths in the radio frequency region, the microwave region and the optical (both visible and invisible) region, as several non-limiting and non-exhaustive examples.

Furthermore, some of the features of the various non-limiting and example embodiments of this invention may be used to advantage without the corresponding use of other features. As such, the foregoing description should be considered as merely illustrative of the principles, teachings and example embodiments of this invention, and not in limitation thereof.

We claim:

1. An apparatus comprising:

an antenna;

a first feed port defining a first end of the antenna and a second feed port defining a second end of the antenna;

a third feed port that interfaces to the antenna at an intermediate point between the first and second ends;

an impedance disposed along the antenna and configured such that in a first mode signals to or from the first and second feed ports resonate along the whole of the antenna and in a second mode signals to or from the third feed port resonate along a portion of the antenna, said portion terminating at the impedance;

and in which the signals in the first mode comprise signals in a first frequency band, and the signals in the second mode comprise signals in a second frequency band and signals in a third frequency band;

wherein:

the impedance comprises a first impedance and a second impedance arranged serially along the antenna;

the first impedance is configured to pass signals in the first and second frequency bands and to block signals in the third frequency band from reaching the second impedance; and the second impedance is configured to pass signals in the first frequency band and to block signals in the third frequency band.

2. The apparatus according to claim 1, wherein the signals in the first mode comprise near field signals having an average range of less than one meter and the signals in the second mode comprise far field signals having an average range of at least five meters.

3. The apparatus according to claim 2, wherein the near field signals comprise radio-frequency identification RFID signals and the far field signals comprise at least one of frequency modulation FM radio signals, global positioning system GPS signals, Bluetooth signals, and wireless local area network WLAN signals.

4. The apparatus according to claim 1, in which the antenna is configured to operate in the first mode and in the second mode simultaneously.

5. The apparatus according to claim 1, wherein the antenna operates in the first mode as a balanced antenna and the antenna operates in the second mode as an unbalanced antenna.

6. The apparatus according to claim 1, further comprising a radio frequency identification RFID radio operatively coupled to the antenna via the first and second feed ports and no other radios operatively coupled to the antenna via the first or second feed ports, and a plurality of non-RFID radios operatively coupled to the antenna via the third feed port.

7. The apparatus according to claim 1, wherein the impedance comprises one of a band pass filter or a low pass filter configured to pass signals in the first mode and to block signals in the second mode.

8. The apparatus according to claim 1, wherein the first impedance comprises an LC tank circuit.

9. The apparatus according to claim 8, wherein the second impedance comprises an inductor.

10. The apparatus according to claim 1, wherein the first frequency band is a radio-frequency identification RFID band, the second frequency band is a frequency modulation FM band, and the third frequency band is selected from at least one of a Bluetooth band, a wireless local area network band, and a global positioning system band.

11. The apparatus according to claim 1, disposed within a wireless handset device which further comprises:

a radio-frequency identification RFID radio operatively coupled to the antenna via the first feed port and the second feed port;

at least one of a frequency modulation FM radio, a Bluetooth radio, a wireless local area network WLAN radio and a global positioning system GPS radio operatively coupled to the antenna via the third feed port; and a cellular radio operatively coupled to a cellular antenna that is separate from the antenna.

12. A wireless handset device comprising the apparatus according to claim 1.

13. A method comprising:

operatively coupling a first radio, configured to operate in a first frequency band, to an antenna via a first feed port and a second feed port that define respective first and second ends of the antenna;

operatively coupling at least a second radio, configured to operate in a second frequency band, to the antenna via a third feed port that interfaces to the antenna at an intermediate point between the ends;

operatively coupling a third radio, configured to operate in a third frequency band, to the antenna via the third feed port, in which no radio apart from the first radio is operatively coupled to the antenna via both the first and the second feed ports, and there are a plurality of radios that are operatively coupled to the antenna via the third feed port;

wherein the antenna comprises an impedance disposed along the antenna between the third feed port and the first feed port, said impedance configured to pass signals within the first frequency band and to block signals within the second frequency band;

in which:

the said impedance comprises a first impedance and the antenna further comprises a second impedance arranged along the antenna serially with the first impedance between the first impedance and the third feed port;

the first impedance is configured to pass signals in the first frequency band and to block signals in the second frequency band; and the second impedance is configured to pass signals in the first frequency band and to block signals in the third frequency band from reaching the second impedance.

14. The method according to claim 13, wherein the first radio comprises a radio-frequency identification RFID radio and the second radio is selected from the group consisting of frequency modulation FM radio, global positioning system GPS radio, Bluetooth radio, and wireless local area network WLAN radio.

15. The method according to claim 13, wherein the first radio is a radio-frequency RFID radio, the second radio is selected from at least one of a Bluetooth radio, a wireless local area network WLAN radio, and a global positioning system GPS radio; and the second radio is selected from at least one of a frequency modulation FM receiver and a frequency modulation FM transmitter.

16. The method according to claim 13, wherein the impedance comprises an LC tank circuit.

17. The method according to claim 13, the method further comprising operatively coupling a cellular radio to a cellular antenna separate from the antenna and disposing the first radio, the second radio, the cellular radio, the antenna with the impedance, and the cellular antenna within a mobile handset housing.

* * * * *